United States Patent [19]

Zambon

[11] 4,282,978

[45] Aug. 11, 1981

[54] BRIDGE CRANE FOR THE EMPLACEMENT OF ELONGATE PREFABRICATED MEMBERS OF STRUCTURES SPANNING A MULTIPLICITY OF SPACED-APART SUPPORTS

[76] Inventor: Antonio Zambon, Via Gorizia, Tradate (Varese), Italy

[21] Appl. No.: 115,710

[22] Filed: Jan. 28, 1980

[51] Int. Cl.[3] ..... B66C 17/06

[52] U.S. Cl. ..... 212/205; 14/1; 52/749

[58] Field of Search ..... 212/74, 205, 214–219; 52/749; 14/1

[56] References Cited

U.S. PATENT DOCUMENTS

| | | | |
|---|---|---|---|
| 3,490,605 | 1/1970 | Koss | 212/74 X |
| 3,902,212 | 9/1975 | Muller | 52/749 X |

*Primary Examiner*—Robert G. Sheridan
*Attorney, Agent, or Firm*—Karl F. Ross

[57] ABSTRACT

Precast beams or slabs of an elongate structure such as a bridge, viaduct or overpass are emplaced on spaced-apart piers by a bridge crane which comprises a framework consisting of a pair of parallel trusses interconnected by end portals and long enough to extend across three piers. Each truss has a bottom stringer formed on its underside with tracks engaged above each pier by rollers mounted on a pair of rocker arms which are part of an undercarriage movable on transverse guide rails. Top stringers of the trusses support a trolley carrying hoists for raising and lowering the transported castings. Longitudinal movement of the framework relative to the piers is brought about by a motor-driven capstan, carried on the framework, which is engaged by cables wound about deflecting rollers at the ends of the framework and on an anchor frame to which the ends of the cables are fastened, the anchor frame being secured to one of the undercarriages and carrying pulleys coacting with confronting deflecting rollers to form a tackle with a fourfold mechanical advantage.

9 Claims, 7 Drawing Figures

56
56'
50
55
54'
57
54'
52"
53
51
52
52'
5
51
52"
54
19
19
14
13
13
14
11
56"
12
48
58
18
42
4
12
41'
40
41
15
15
15
15
IV
19
19
43"
16
16
27
27
6C
45
43
24
25
20
20

2b
22
23
3b
IV

BRIDGE CRANE FOR THE EMPLACEMENT OF ELONGATE PREFABRICATED MEMBERS OF STRUCTURES SPANNING A MULTIPLICITY OF SPACED-APART SUPPORTS

FIELD OF THE INVENTION

My present invention relates to a bridge crane as used for the emplacement of slabs, beams and similar elongate prefabricated members (usually of reinforced concrete) for the erection of support-spanning structures such as overpasses, viaducts or bridges.

BACKGROUND OF THE INVENTION

When a structure to be built up from such prefabricated members is long enough to extend across three or more supporting piers, their emplacement generally requires the use of a bridge crane which can be moved horizontally across these piers and also carries hoist means for raising the precast beams or slabs off an adjoining landing and depositing them in proper position on the piers. The equipment heretofore employed for this purpose has been relatively cumbersome and not very reliable in operation, particularly in those instances in which a single control mechanism is utilized for the horizontal crane motion and for the operation of the hoist. Even with separate driving and hoisting mechanisms the performance has not always been satisfactory.

OBJECT OF THE INVENTION

The object of my present invention, therefore, is to provide an improved bridge crane for the purpose set forth which is of simple construction and dependable in operation.

SUMMARY OF THE INVENTION

I realize this object, in accordance with my present invention, by the provision of at least three roller mountings respectively disposed on as many piers designed to form part of the structure to be erected, these mountings slidably supporting the lower stringers of an elongate framework having two rigidly interconnected spaced-apart trusses. The upper stringers of the framework carry hoist means displaceable thereon for elevating a prefabricated member into the space between the trusses and transporting same longitudinally of the framework before depositing it at the requisite location. The longitudinal displacement of the framework itself, relative to its roller mountings, is performed by drive means including a motor-driven capstan on the framework, one or more cables being wound around the capstan and passing around a set of deflecting rollers on the framework while being anchored to one of the roller mountings. The latter mounting, advantageously, has an extension provided with pulleys which are embraced by the cable or cables and form with the aforementioned deflecting rollers a tackle providing a fourfold mechanical advantage.

Pursuant to another advantageous feature of my invention, the deflecting rollers include end rollers positioned at opposite extremities of the framework for preventing any sagging thereof when one of the ends of the framework is cantilevered between piers.

In order to permit the framework to be shifted parallel to itself, the roller mountings may comprise undercarriages guided for transverse movement on their respective piers. These undercarriages preferably have rocker arms oscillatable about transverse axes, the lower stringers of the framework having tracks engaged by supporting rollers carried on these rocker arms.

BRIEF DESCRIPTION OF THE DRAWING

The above and other features of my invention will now be described in detail with reference to the accompanying drawing in which.

SPECIFIC DESCRIPTION

Figure 1:
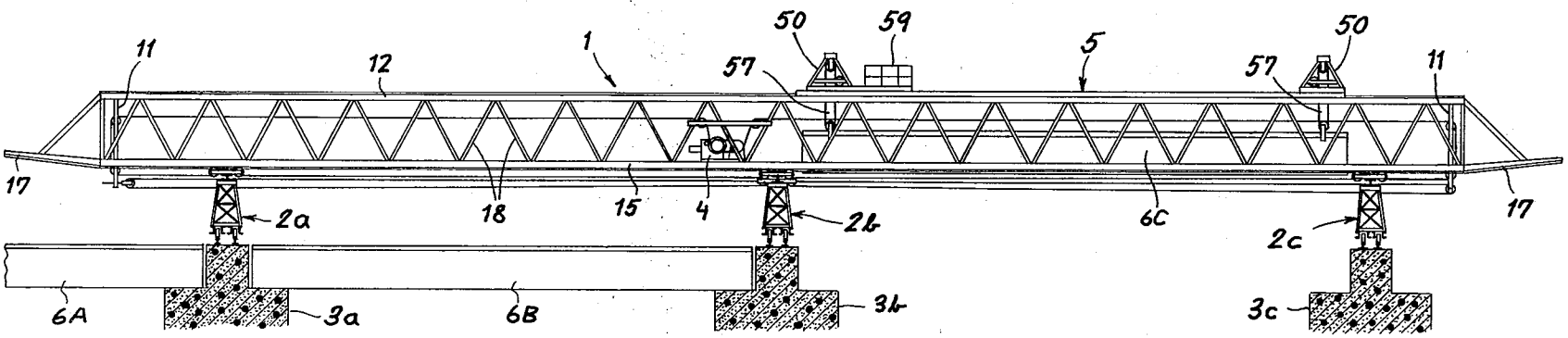
FIG. 1 is a side-elevational view of my improved bridge crane.
Figure 2:
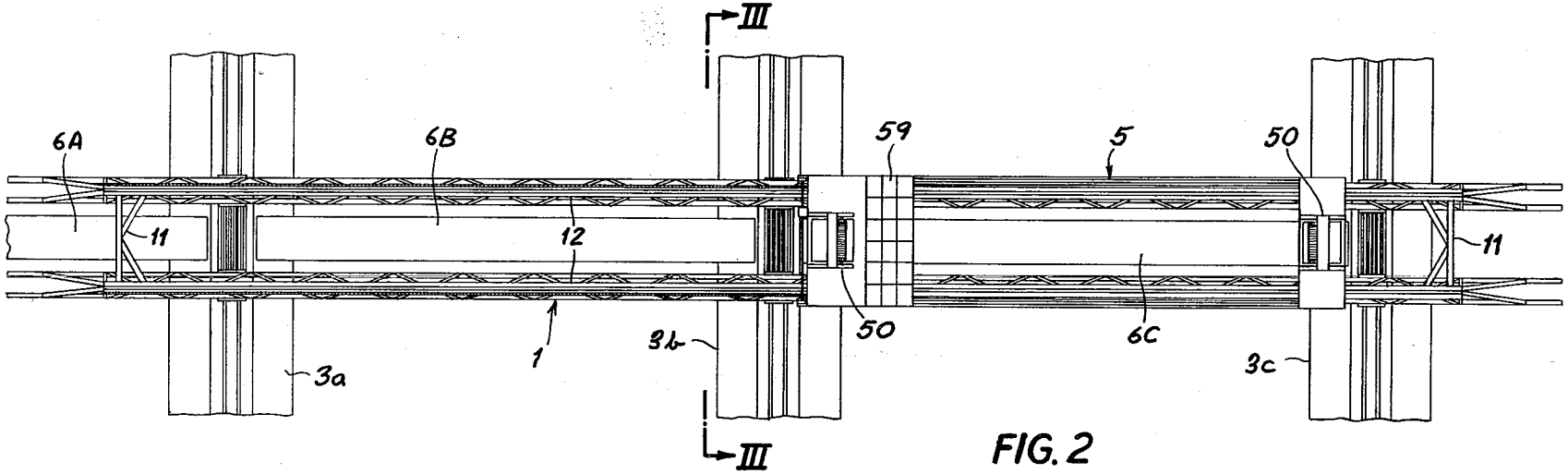
FIG. 2 is a top view of the bridge crane shown in FIG. 1.

The drawing represents a bridge crane to be used in erecting a structure spanning a number of piers some of which have been shown at 3*a*, 3*b* and 3*c*. At the illustrated stage of construction, two precast beams 6A, 6B of reinforced concrete are already in place while a third beam 6C is in the process of being lowered by the crane onto the piers 3*b* and 3*c*. The crane comprises a framework 1 whose length exceeds, e.g. by about four to six meters, the spacing of piers 3*a* and 3*c* which it overlies in its illustrated working position. Framework 1 is temporarily supported on piers 3*a*, 3*b* and 3*c* by respective roller mountings 2*a*, 2*b* and 2*c* of identical construction which, as best illustrated for the mounting 2*b* in FIGS. 3 and 4, have wheels 23 riding on rails 21 atop the associated piers. These mountings constitute laterally movable undercarriages provided with individual but mutually synchronized drive motors, not shown, which are coupled with their traction wheels 23 to allow the entire framework 1 to be shifted transversely along the piers as required for the positioning of several precast beams or slabs side by side on a pair of confronting pier ledges.

Figure 3:
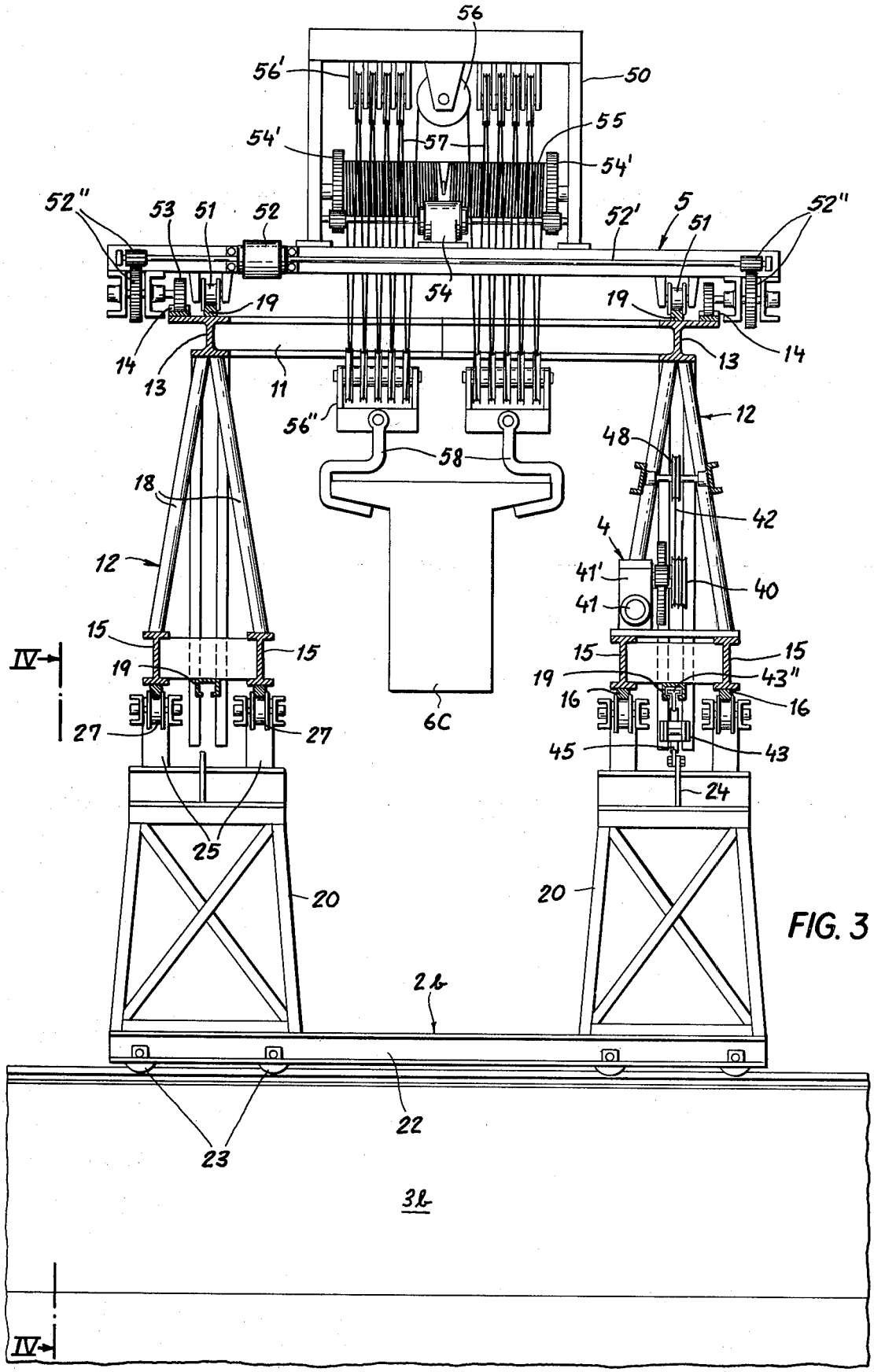
FIG. 3 is a cross-sectional view taken on the line III—III of FIG. 2 but drawn to a larger scale.
Figure 4:
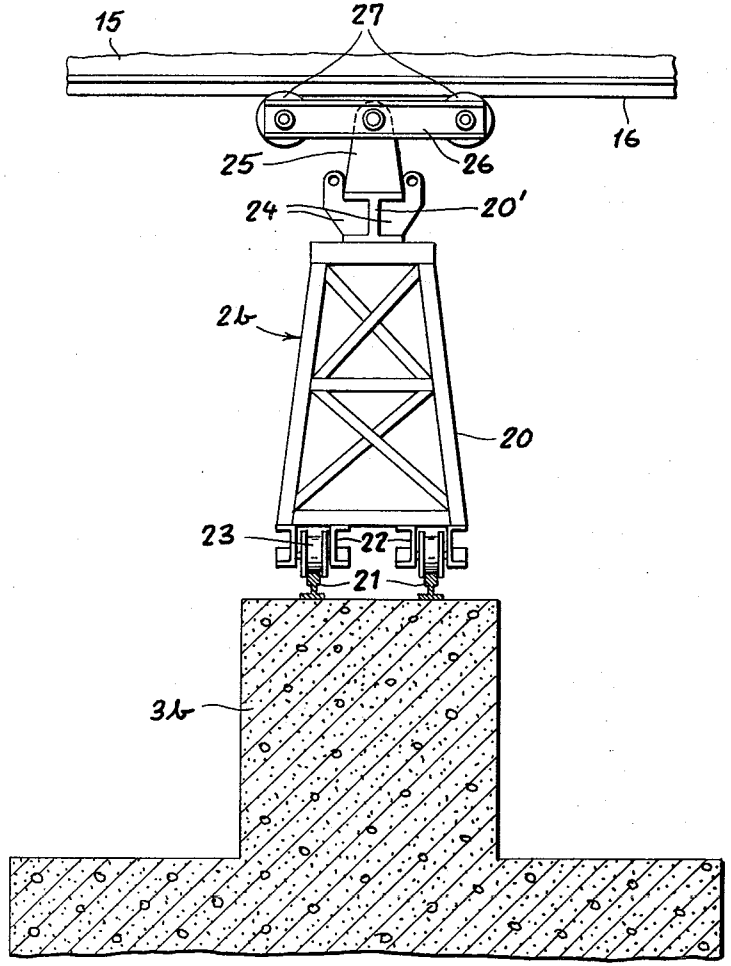
FIG. 4 is a side view of a roller mounting as seen on the line IV—IV of FIG. 3.

Framework 1 consists of two parallel trusses 12 rigidly interconnected at their ends by portals 11, each truss having an upper stringer 13 and two lower stringers 15 linked by struts 18 to form a latticework of generally triangular cross-section as best seen in FIG. 3. Advantageously, each truss is subdivided into a multiplicity of longitudinally adjoining interchangeable sections allowing its length to be varied; thus, as seen in FIG. 6, each stringer 13 or 15 is composed of a multiplicity of steel profiles 13' or 15', e.g. about twelve meters long, bolted together in end-to-end relationship. The lower stringers 15 are provided along their underside with tracks 16 riding on rollers 27 of the several undercarriages, these rollers being mounted in pairs on rocker arms 26 as illustrated in FIG. 4 for the carriage 2*b* and in FIG. 5 for a modified undercarriage 102. More particularly, carriage 2*b* has two spaced-apart bases 20 (see also FIG. 3) interconnected by a frame 22 on which the wheels 23 are journaled; each base 20 carries an I-profile 20' with two uprights 25 to which a respective rocker arm 26 is pivoted. Between uprights 25 the profile 20' is flanked by a pair of lugs 24 for a purpose to be described.

Figure 5:
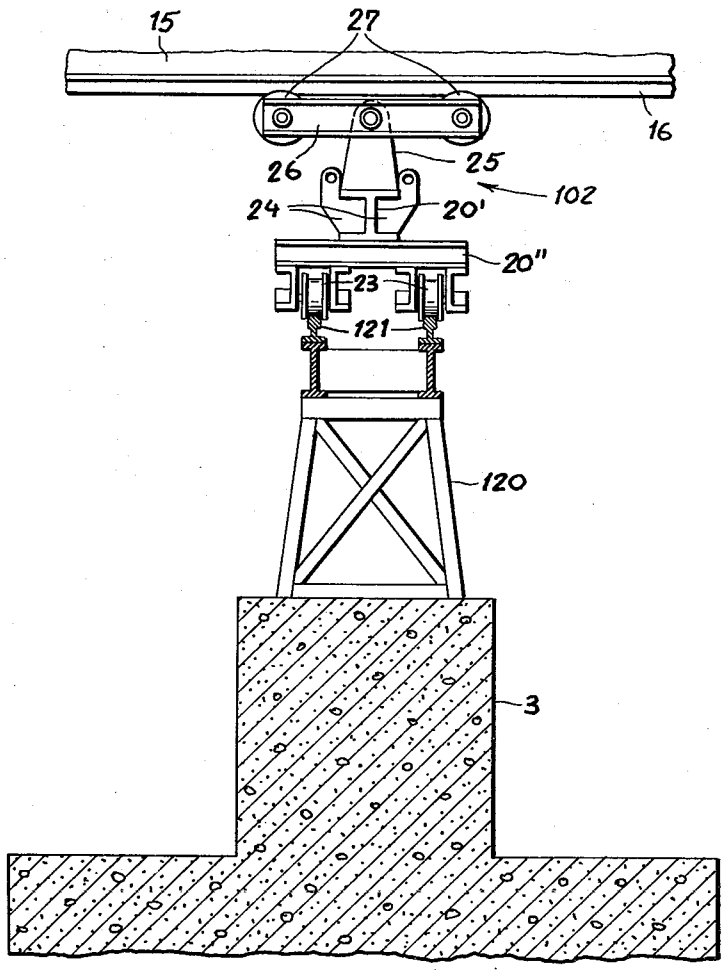
FIG. 5 is a view similar to FIG. 4, illustrating a modified roller mounting.
Figure 6:
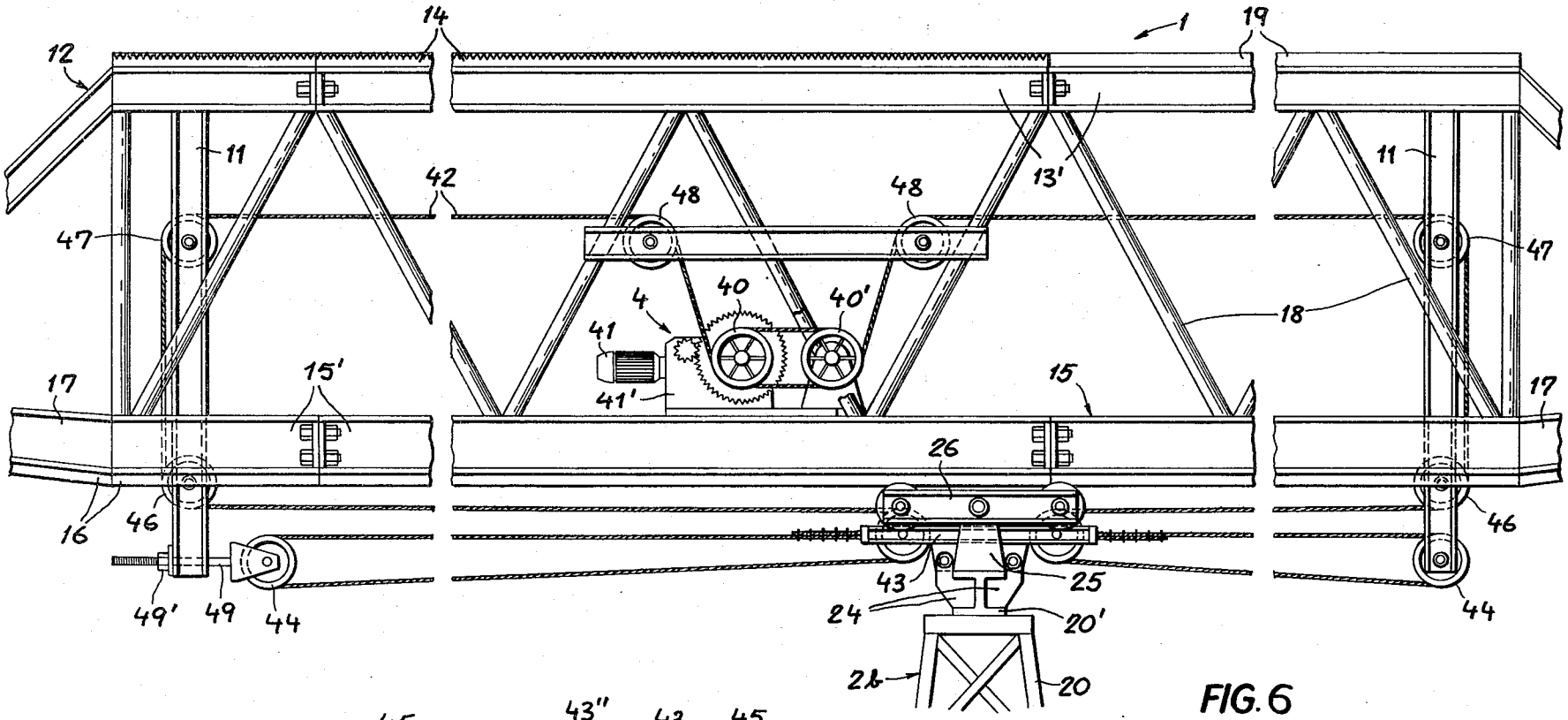
FIG. 6 is an enlarged side view of part of the bridge crane, showing details of its drive mechanism.

In the modified undercarriage 102 of FIG. 5 the tall base 20 has been replaced by a shallow frame 20''. The traction wheels 23, on that frame, ride on rails 121 atop a stationary base 120 which extends over substantially the entire length of the associated pier 3.

The lower stringers 15 terminate in a pair of upwardly inclined spars 17 designed to facilitate the engagement of their tracks 16 with the rollers 27 of an undercarriage on a pier which is being approached by the advancing crane.

Each upper stringer 13 carries a track 19, extending over its full length, and alongside that track a rack 14 which may be limited to a portion of its length. Tracks 19 are engaged by rollers 51, FIG. 3, on the underside of a trolley 5 spanning the two trusses 12. Trolley 5 is provided with a motor 52 driving, via a common shaft 52', a pair of speed-reducing gear trains 52'' which are connected with respective pinions 53 meshing with the racks 14. This insures proper positioning of a transported beam or slab even on a sloping part of the structure to be erected. Two longitudinally spaced hoists 50 on trolley 5 each include a motor 54 driving, via reducing gears 54', a winch 55 embraced by two trunks of a cable 57 also passing about a central pulley 56, a pair of upper pulley blocks 56' and a pair of lower pulley blocks 56''. The latter blocks carry hooks 58 designed to grip the transported structural member, here the precast beam 6c, by the flange of its T-shaped profile. The two winch-driving motors 54 of trolley 5 may be synchronized either mechanically or electrically.

A platform 59 on trolley 5 is provided with a control panel for operating the hoist motors 52 and 54 as well as a drive mechanism 4 for the bidirectional motion of the bridge crane.

Mechanism 4 comprises a motor 41 with a speed reducer 41' mounted on the base of one of the trusses 12, a capstan 40 driven by the speed reducer, and a cable 42 partly wound about the capstan while forming two loops about respective sets of deflecting rollers 44–48. The ends of cable 42 are anchored to an extension 43 of undercarriage 2b to which that extension is fastened by being bolted to the lugs 24 thereof. Extension 43 is a frame carrying two rollers 45 that are part of the aforementioned sets. Rollers 44 are mounted directly on the truss 12 below the level of its lower stringers 15, one of these latter rollers being adjustably secured to the truss through a threaded rod 49 engaged by a nut 49' to enable proper tensioning of the cable. Rollers 46 and 47 are disposed within the truss near the extremities thereof, close to its spars 17, whereby these extremities are subjected to a force tending to hold each end of the crane horizontal to prevent its sagging below the level of the rocker arms 26 when that end is cantilevered between two piers. Rollers 44–46 act as cable pulleys constituting a tackle with a fourfold mechanical advantage whereby the crane-driving motor 41 may be of relatively low power.

Figure 7:
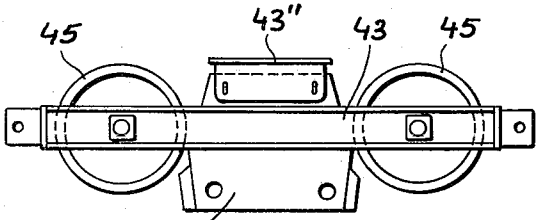
FIG. 7 is a further-enlarged view of an extension of a roller mounting forming part of the drive mechanism of FIG. 6.

As best seen in FIG. 7, the frame 43 carrying the rollers 45 is provided with a vertical mounting plate 43' bounded at the top by a T-profile 43'' which is slidingly received in a channel member 19 on the underside of the associated truss 12. The lower end of plate 43' has holes for the bolts by which it is attached to the lugs 24. From FIG. 3 it will be noted that a channel member 19, like lugs 24, is also provided on the other truss 12 and base 20 so that, if desired, drive mechanism 4 could be duplicated on that other truss (with suitable synchronization of the two motors 41).

The control panel on platform 59 could also include switches for operating, possibly via radio links, the nonillustrated drive motors of carriages 2a–2c (or 102) and similar carriages on other piers, if any, for a lateral shifting of the bridge.

The single trolley 5 with two hoist 50 could be replaced, if desired, by two independent trolleys with separate but synchronizable drive and hoist motors 52, 54. In that case, of course, the racks 14 engaged by the respective pinions 53 of these trolleys would have to extend over substantially the full length of each truss 12.

I claim:

1. A bridge crane for emplacing elongate prefabricated members of a structure spanning a series of spaced-apart transversely extending piers, comprising:

at least three roller mountings respectively disposed on as many of said piers;

an elongate framework with two rigidly interconnected spaced-apart trusses having upper and lower stringers separated by a longitudinal space, said lower stringers being slidably supported on said roller mountings;

hoist means displaceably mounted on said upper stringers for elevating a prefabricated member into the space between said trusses and transporting said member longitudinally of said framework; and drive means for longitudinally displacing said framework relatively to said roller mountings, said drive means including a motor-driven capstan on said framework, cable means wound around said capstan, and a set of deflecting rollers on said framework, said cable means passing around said deflecting roller and being anchored to one of said roller mountings.

2. A bridge crane as defined in claim 1 wherein said drive means further includes an extension of said one of said roller mountings provided with pulleys embraced by said cable means, said pulleys forming with said deflecting rollers a tackle providing a fourfold mechanical advantage.

3. A bridge crane as defined in claim 2 wherein said deflecting rollers include end rollers positioned at opposite extremities of said framework for holding the ends of said framework substantially horizontal.

4. A bridge crane as defined in claim 1, 2 or 3 wherein at least one of said deflecting rollers is provided with an adjustable support for varying the tension of said cable means.

5. A bridge crane as defined in claim 1, 2 or 3 wherein said roller mountings include guided undercarriages displaceable along said piers for enabling transverse movement of said framework.

6. A bridge crane as defined in claim 5 wherein said undercarriages are provided with rocker arms oscillatable about transverse axes, said rocker arms carrying supporting rollers, said lower stringers being provided with tracks engaged by said supporting rollers.

7. A bridge crane as defined in claim 6 wherein each of said trusses is of generally triangular cross-section with the upper stringer thereof at a vertex and the lower stringer thereof at a base of the triangle, said tracks including a pair of transversely spaced guide rails on the underside of said lower stringer.

8. A bridge crane as defined in claim 1, 2 or 3 wherein said hoist means comprises a trolley with motor-driven pinions coacting with rack teeth on said upper stringers.

9. A bridge crane as defined in claim 1, 2 or 3 wherein each of said trusses consists of a multiplicity of substantially identical latticework sections longitudinally bolted to one another.

* * * * *